US005320429A

United States Patent [19]

Toyosawa

[11] Patent Number: 5,320,429

[45] Date of Patent: Jun. 14, 1994

[54] LAUNDRY NET FOR BRASSIERES

[75] Inventor: Manabu Toyosawa, Tokyo, Japan

[73] Assignee: Daiya Corporation, Tokyo, Japan

[21] Appl. No.: 998,594

[22] Filed: Dec. 30, 1992

[30] Foreign Application Priority Data

Jan. 7, 1992 [JP] Japan ..... 4-003546[U]

[51] Int. Cl.[5] ..... B65D 30/06; B65D 30/10

[52] U.S. Cl. ..... 383/117; 383/97; 383/907

[58] Field of Search ..... 383/97, 102, 117, 907; 2/89, 94, 206

[56] References Cited

U.S. PATENT DOCUMENTS

| | | | |
|---|---|---|---|
| 2,565,394 | 8/1951 | Ryan | 383/102 X |
| 4,503,560 | 3/1985 | Bourne | 383/907 X |
| 4,865,463 | 9/1989 | Howard | 383/117 X |
| 4,887,316 | 12/1989 | Morandini | 2/174 |
| 4,974,967 | 12/1990 | Tsuyoshi | 383/117 X |

*Primary Examiner*—Allan N. Shoap
*Assistant Examiner*—Jes F. Pascua
*Attorney, Agent, or Firm*—Edmund M. Jaskiewicz

[57] ABSTRACT

A laundry net for holding a brassiere while the brassiere is being laundered has a dome-shaped bag having a substantially circular bottom member and a substantially conical upper member joined thereto for covering cups of the brassiere. Each of the bottom and upper members comprises first, second, and second nets each made of a water-permeable material, the first and second nets having a relatively coarse mesh and being spaced from each other, the first and second nets being joined to each other by a plurality of elastic threads, the third net having a relatively fine mesh and being positioned inwardly of the first and second nets, the third net being spaced from the second net. The bag has an opening defined along a ridge of the upper member for taking the brassiere into and out of the bag. The opening can selectively be opened and closed by a slide fastener.

4 Claims, 6 Drawing Sheets

LAUNDRY NET FOR BRASSIERES

BACKGROUND OF THE INVENTION

1. Field of the Invention

The present invention relates to a laundry net for holding a brassiere while it is being laundered, and more particularly to a laundry net for protecting the brassiere placed therein from being deformed out of shape when it is laundered in a washing machine, thereby allowing the brassiere to be laundered neatly.

2. Description of the Prior Art

Various garments, including pants, shirts, and underwear, are laundered in washing machines. There have been proposed various laundry nets for holding such garments to protect them while they are being machined-washed, and such laundry nets differ in size, shape, and design depending on the garments to be held therein. While different laundry nets have also been proposed for brassieres, laundry nets which are of a shape suitable for holding brassieres have not been proposed in the art so far.

FIG. 10 of the accompanying drawings shows, in perspective, a conventional laundry net disclosed in Japanese Utility Model publication No. 3-49667 which has been proposed by the applicant. The disclosed laundry net is used to hold an undergarment made of fine-quality fibers.

As shown in FIG. 10, the conventional laundry net has a bag 10 comprising net components 11, 12 sewn to each other along their edges. The net components 11, 12 are made of a fabric material selected not to damage the undergarment placed in the bag 10 while the undergarment is being washed.

The bag 10 also includes bias tapes 20 wrapped around the stitched edges of the net components 11, 12 and positioned outside of the bag 10. The bag 10 has an opening for taking the undergarment into and out of the bag 10, the opening being openably closed by a slide fastener or zipper 30.

To launder an undergarment using the laundry net, the slide fastener 30 is opened, the undergarment is placed into the bag 10, the slide fastener 30 is closed, and thereafter the bag 10 is placed into a washing machine in which the undergarment is laundered.

Since the known laundry net is designed to hold an undergarment made of fine-quality fibers, the net components 11, 12 are also made of fine-quality fibers so that they will not damage the undergarment when in contact therewith.

However, when a brassiere with dome-shaped cups is laundered together with stockings or other underwear in the laundry net, or a plurality of such brassieres are laundered in the laundry net, the brassiere or brassieres may be deformed out of shape under pressure from the other undergarments laundered together.

SUMMARY OF THE INVENTION

It is an object of the present invention to provide a laundry net for effectively protecting a brassiere placed therein from being deformed out of shape when it is laundered in a washing machine, thereby allowing the brassiere to be laundered neatly.

According to the present invention, there is provided a laundry net for holding a brassiere while the brassiere is being laundered, comprising a dome-shaped bag having a substantially circular bottom member and an upper member curved connected thereto for covering cups of the brassiere.

The cups of the brassiere as they are superimposed can snugly be retained in the dome-shaped bag for protection against damage. Therefore, the brassiere can neatly be laundered in a washing machine without being deformed out of shape under external stresses.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

As shown in FIGS. 1 through 5, a laundry net for brassieres according to an embodiment of the present invention has a dome-shaped bag 1 comprising a substantially flat bottom member 2 and a substantially conical or curved upper member 3. As shown in FIG. 6, the bottom member 2 comprises a substantially circular bottom piece 2', and the upper member 3 is composed of a pair of substantially triangular upper pieces 3'. The triangular pieces 3' of the piece 2' of the upper member 3 have respective bottom edges **3*a* sewn to opposite edges 2*a* of the piece 2' of the bottom member 2**.

Figure 5:
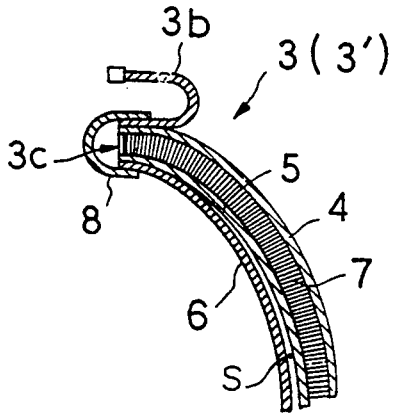
FIG. 5 is a fragmentary cross-sectional view of the laundry net.
Figure 6:
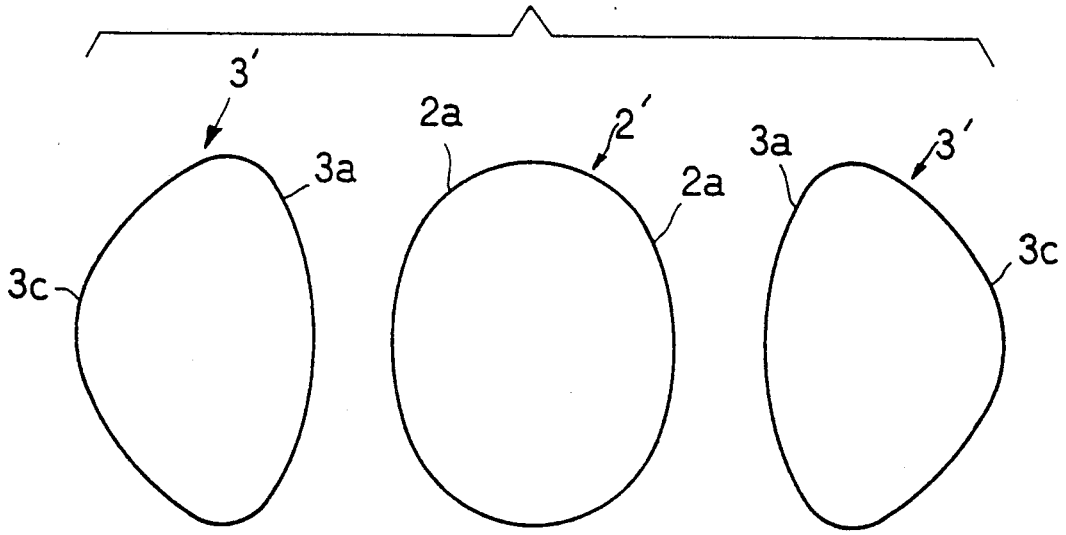
FIG. 6 is an exploded view of the laundry net.

As shown in FIG. 5, each of the bottom piece 2' and the upper pieces 3' comprises three superimposed nets 4, 5, 6 which are highly permeable to water.

The first and second nets 4, 5 are of relatively coarse mesh to allow water to pass smoothly therethrough. The second net 5 is spaced inwardly from the first net 4, and joined thereto by a plurality of elastic threads 7 therebetween. The first and second nets 4, 5 which are thus combined together have a certain rigidity and elasticity under external stresses applied thereto.

The third net 6 is positioned inwardly of the second net 5 for direct contact with a brassiere when the brassiere is held in the bag 1. Therefore, the third net 6 is of relatively fine mesh for protecting the brassiere against damage when placed in the bag 1. The third net 6 serves to prevent the hooks of the brassiere from being caught by the second net 5, and is also effective to prevent waste threads from entering the bag 1. The third net 6 is not held in intimate contact with the second net 4, but is spaced thereby by a gap S. The third net 6 is thus slidable with respect to the second net 5 in a certain distance range. Since the third net 6 is movable, any friction or rubbing between the third net 6 and the brassiere is reduced, thereby preventing the brassiere from being damaged and also from developing small fiber tangles.

Figure 1:
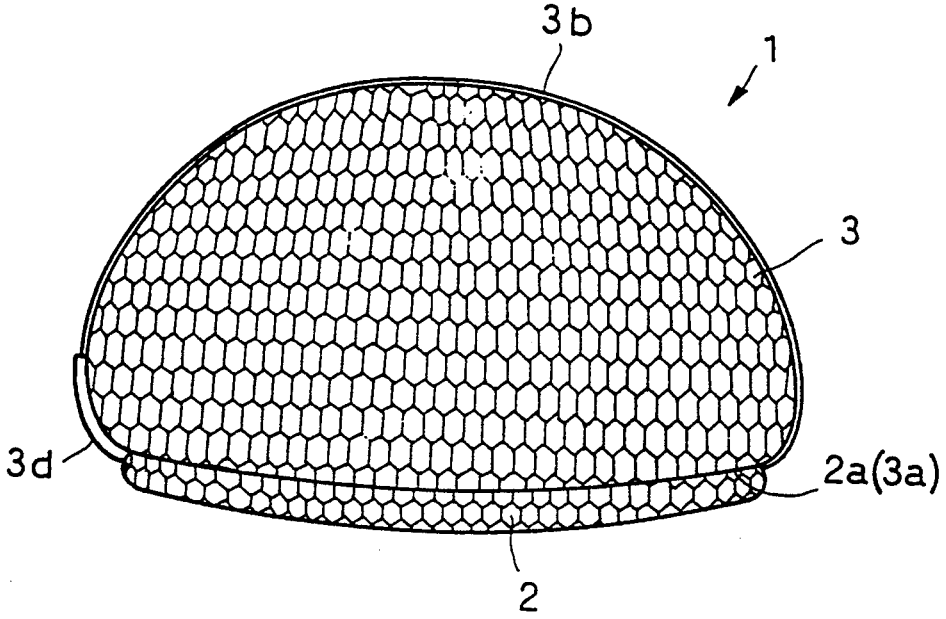
FIG. 1 is a front elevational view of a laundry net for brassieres according to an embodiment of the present invention.
Figure 2:
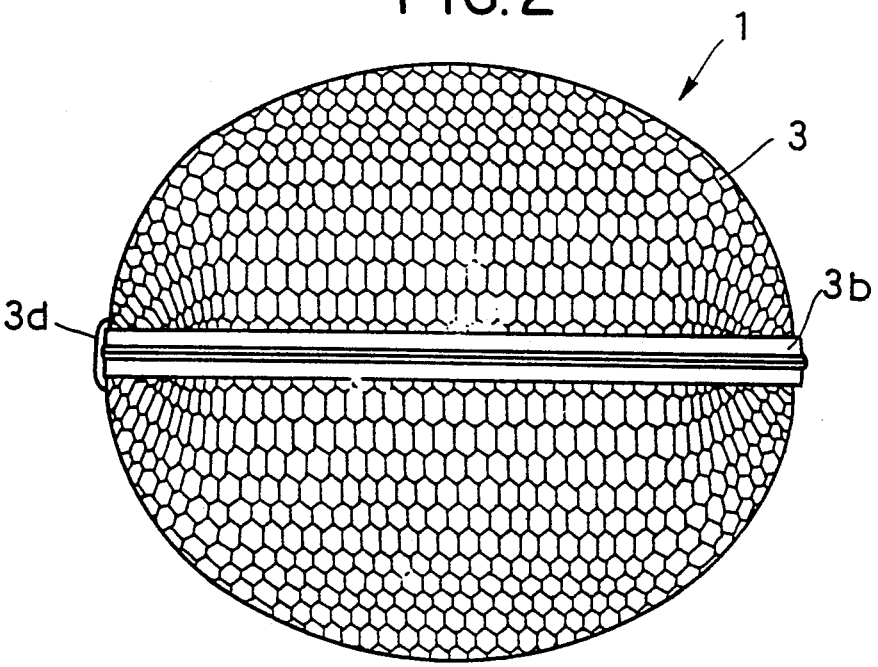
FIG. 2 is a plan view of the laundry net.
Figure 3:
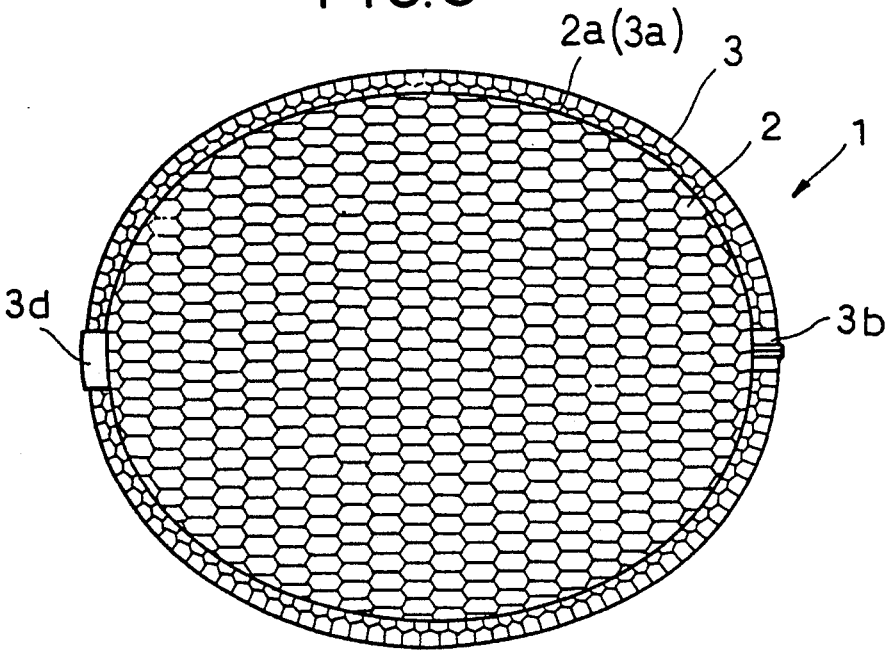
FIG. 3 is a bottom view of the laundry net.
Figure 4:
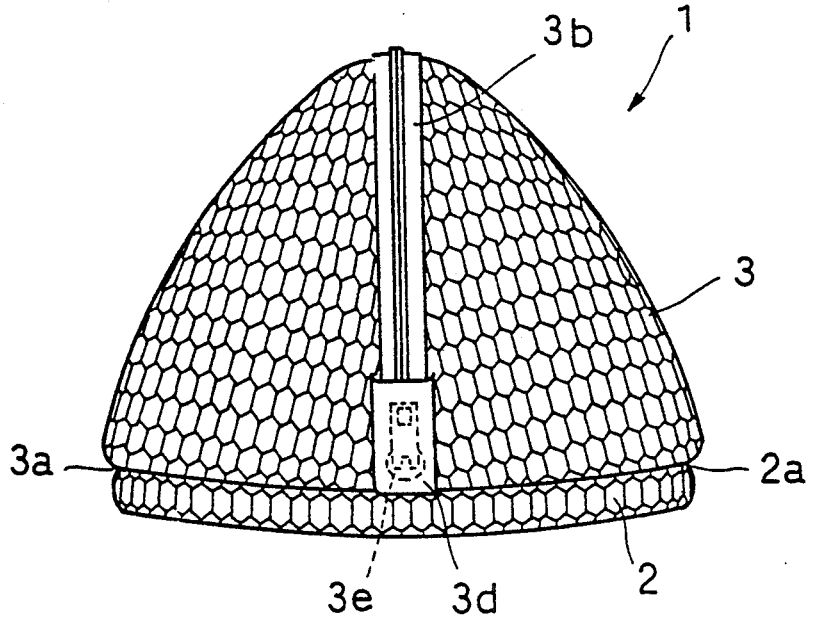
FIG. 4 is a side elevational view of the laundry net.

As shown in FIGS. 1 and 3, the bottom member 2 is of a substantially flat, slightly elongate, circular shape for supporting the bottom of the cups of the brassiere which will be held in the bag 1.

The upper member 3 is of a conical shape for covering the cups of a brassiere when it is stored in the bag 1. The upper member 3 is of such a size as to be able to hold two or three brassieres simultaneously with their cups superimposed. The upper member 3 is large enough to loosely hold the brassieres, but small enough to prevent them from being turned upside down in the bag 1. Since the brassieres are loosely accommodated in the bag 1, they can be laundered effectively.

The laundry net has a slide fastener or zipper **3*b* for openably closing an opening in the bag 1 along a ridge of the upper member 3 for taking brassieres into and out of the bag 1. The slide fastener 3*b* extends along the ridge of the upper member 3, and has its stringer tapes sewn to respective upper edges 3*c* (see FIGS. 5 and 6) of the upper pieces 3' through bias tapes 8. The slide fastener 3*b* has a pull tab 3*e* which can be stored in a pull tab pouch 3*d* attached to the upper member 3 at one end of the slide fastener 3*b***.

The bias tapes 8 are also wrapped around the stitched edges of the bottom and upper members 2, 3 and positioned inside of the bag 1.

Figure 7:
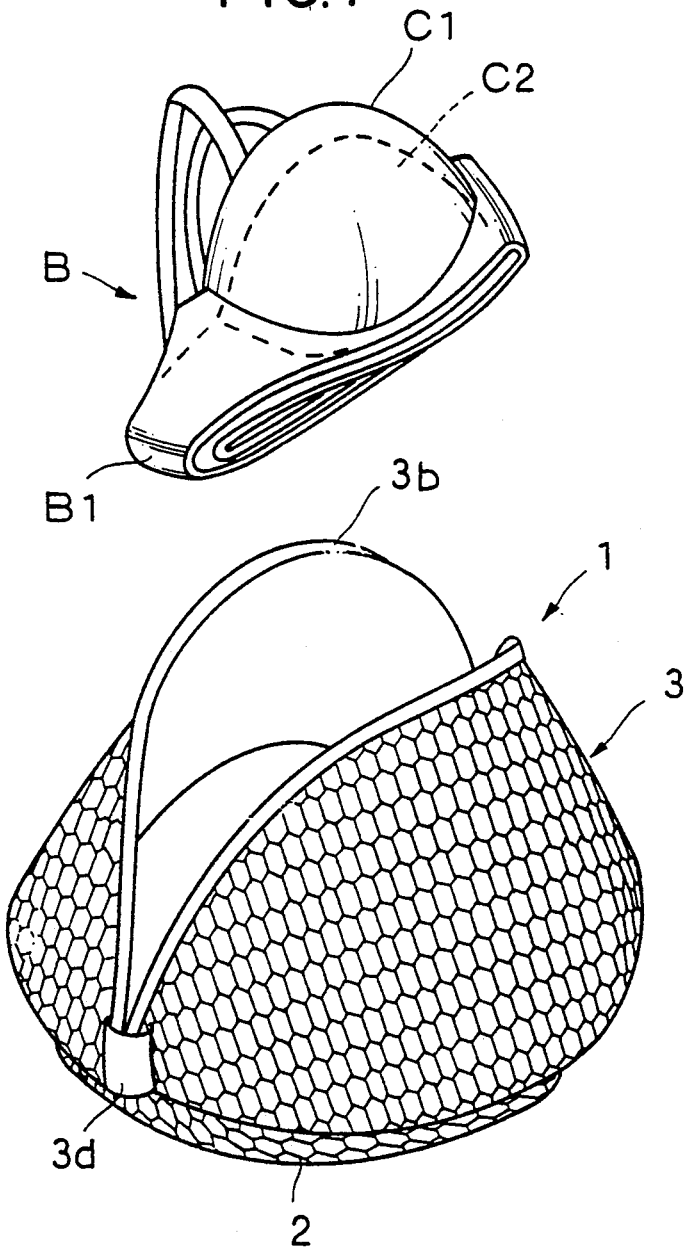
FIG. 7 is a perspective view showing the manner in which the laundry net is to be used.

The laundry net of the above construction is used as follows:

As shown in FIG. 7, one cup C1 of a brassiere B is superimposed on the other cup C2, with a central joint belt B1 folded over on itself. These cups C1, C2 may be superimposed by either pressing one cup inside out and placing it in the other cup with the central joint belt B1 simply folded over on itself or simply placing one cup into the other cup with the central joint belt B1 twisted and folded over on itself.

Then, the slide fastener **3*b* is opened to split open the upper member 3, and the folded brassiere B is placed into the bag 1 with the cups C1, C2 projecting upwardly and their bottom placed on the bottom member 2. If more than one brassiere is to be laundered at the same time, the other brassieres are also folded similarly and placed in the bag 1** with their cups superimposed.

Thereafter, the slide fastener **3*b* is closed, and the bag 1 is put in a washing machine. The washing machine is then started to launder the brassieres in the bag 1**.

Since the laundry net is composed of the substantially circular bottom member 2 for supporting the bottom of the cups C1, C2 of the brassiere B and the conical upper member 3 for holding the cups C1, C2 therein, the brassiere B can neatly be accommodated in the bag 1. As the bottom member 2 is slightly elongate, the bag 1 provides a space for storing the belt B1 therein.

The laundry net according to the present invention thus allows a brassiere or brassieres to be laundered neatly in a washing machine without the danger of getting deformed out of shape.

As described above, the first and second nets 4, 5 which are combined together have a certain rigidity and elasticity under external stresses applied thereto. Consequently, a brassiere or brassieres stored in the bag 1 are securely protected against deformation even when they are jostled in the washing machine.

Inasmuch as the slide fastener **3*b* extends along the ridge of the upper member 3, even if a brassiere or brassieres put in the bag 1 have laces on their cups, such laces are not caught by the slide fastener 3*b***.

Figure 8:
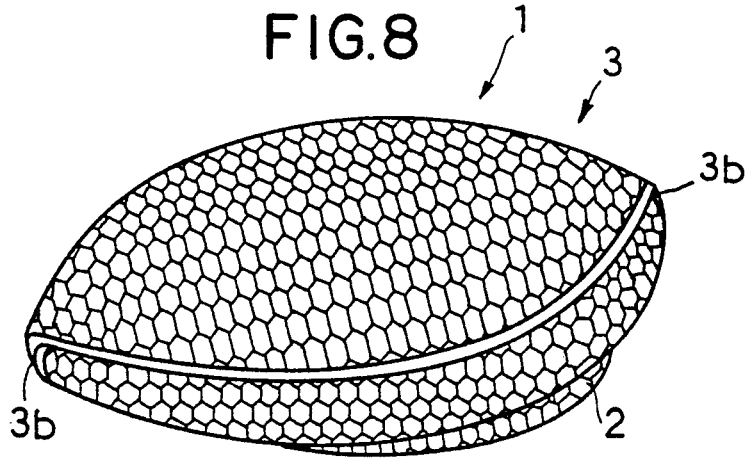
FIG. 8 is a perspective view of the laundry net as it is collapsed for storage or sale.

As shown in FIG. 8, the laundry net can be collapsed into a compact shape for storage or sale. More specifically, the slide fastener **3*b* is opened, and the upper pieces 3' of the upper member 3 are folded one after another on the bottom member 2**. The collapsed laundry net is compact, and particularly convenient because it can be placed in a small package for sale.

While the bag 1 has been shown and described as being of a triple-walled structure, it may be double-walled.

The bottom member 2 may be of a substantially completely circular shape or a more elongate circular shape than illustrated in FIG. 6.

The laundry net may be of a hemispherical shape rather than a dome or conical shape as shown.

Figure 9:
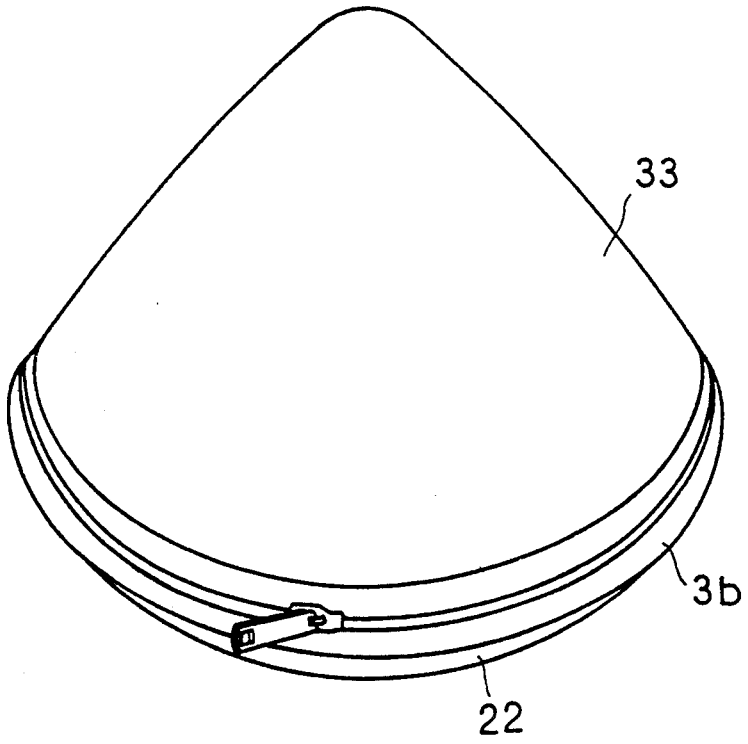
FIG. 9 is a perspective view of a laundry net for brassieres according to another embodiment of the present invention.
Figure 10:
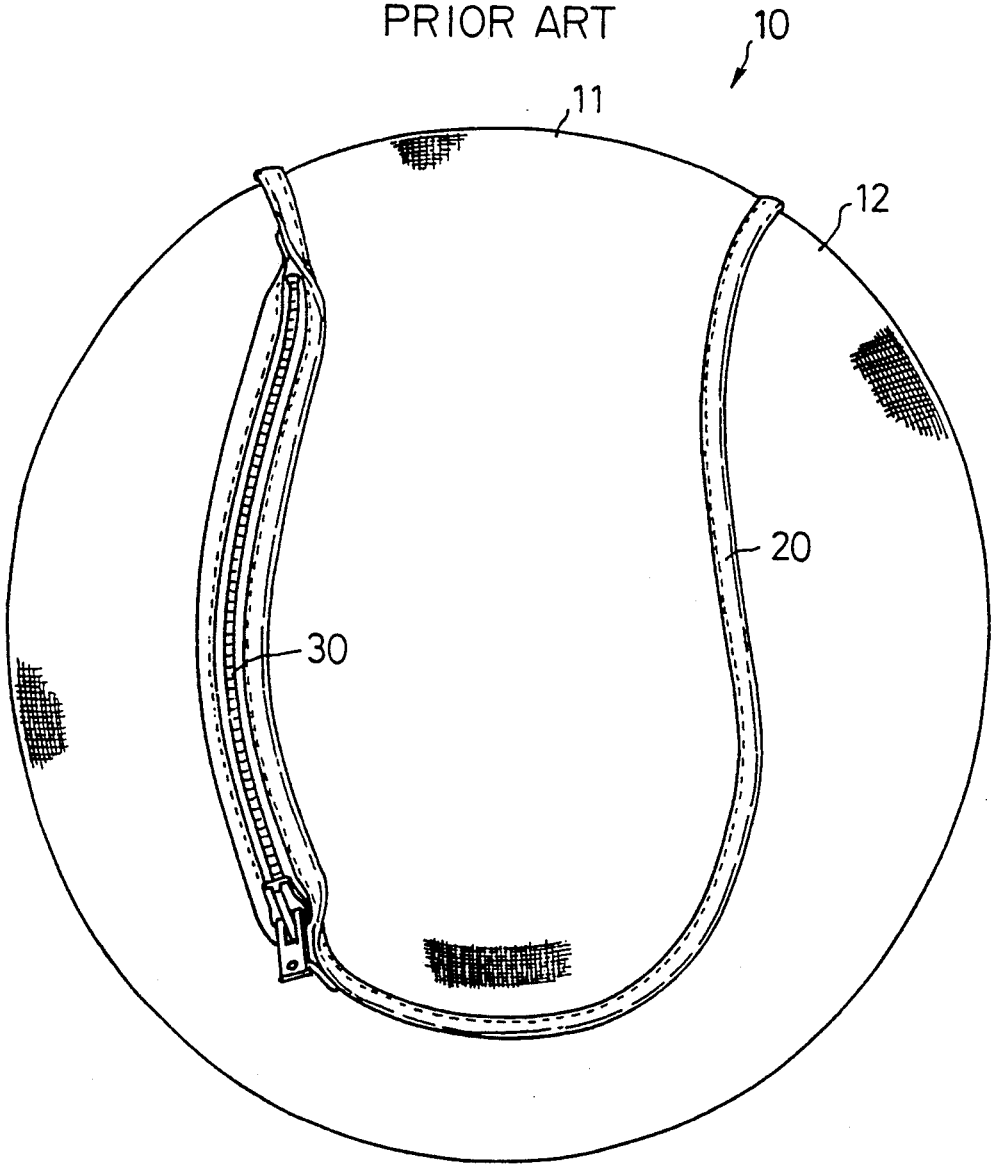
FIG.10 PRIOR ART
FIG. 10 is a perspective view of a conventional laundry net.

FIG. 9 shows a laundry net for brassieres according to another embodiment of the present invention. As shown in FIG. 9, the laundry net has a slide fastener **3*b* extending between a bottom member 22 and an upper member 33. The other details of the laundry net shown in FIG. 9 are identical to those of the laundry net shown in FIGS. 1 through 8**.

Although certain preferred embodiments of the present invention have been shown and described in detail, it should be understood that various changes and modifications may be made therein without departing from the scope of the appended claims.

What is claimed is:

1. A laundry net for holding a brassiere while the brassiere is being laundered, comprising a dome-shaped bag having a substantially circular bottom member and a curved upper member connected thereto for covering cups of the brassiere, each of said bottom and upper members comprises at least first and second nets each made of a water-permeable material, said first and second nets having a relatively coarse mesh and being spaced from each other, said first and second nets being joined to each other by a plurality of elastic threads.

2. A laundry net according to claim 1, wherein each of said bottom and upper members comprises first, second, and third nets each made of a water-permeable material, said first and second nets having a relatively coarse mesh and being spaced from each other, said first and second nets being joined to each other by a plurality of elastic threads, said third net having a relatively fine mesh and being positioned inwardly of said first and second nets, said third net being spaced from said second net.

3. A laundry net for holding a brassiere having cups while the brassiere is being laundered, comprising a substantially dome-shaped bag for accommodating the brassiere with the cups superimposed, said bag comprising a substantially circular flat net member and a substantially conical net member joined along a circumferential edge thereof of said substantially circular flat net member along a circumferential edge thereof, each of said substantially circular flat net member and said substantially conical net member comprises at least first and second nets of a relatively coarse mesh which are spaced from each other, said first and second nets being joined to each other by a plurality of elastic threads.

4. A laundry net according to claim 3 wherein each of said substantially circular flat net member and said substantially conical net member comprises first, second and third nets, said first and second nets being of a relatively coarse mesh and spaced from each other, said first and second nets being joined to each other by a plurality of elastic threads, said third net having a relatively fine mesh and being positioned inwardly of said first and second nets, said third net being spaced from said second net.

* * * * *